US011406949B2

(12) United States Patent
Nakul

(10) Patent No.: US 11,406,949 B2
(45) Date of Patent: Aug. 9, 2022

(54) APPARATUS FOR AGITATION OF FLUIDS

(71) Applicant: Nakul Nakul, Gurgaon (IN)

(72) Inventor: Nakul Nakul, Gurgaon (IN)

( * ) Notice: Subject to any disclaimer, the term of this patent is extended or adjusted under 35 U.S.C. 154(b) by 287 days.

(21) Appl. No.: 16/605,354

(22) PCT Filed: Dec. 15, 2018

(86) PCT No.: PCT/IB2018/060146

§ 371 (c)(1),
(2) Date: Oct. 15, 2019

(87) PCT Pub. No.: WO2020/095100

PCT Pub. Date: May 14, 2020

(65) Prior Publication Data

US 2020/0269202 A1 Aug. 27, 2020

(30) Foreign Application Priority Data

Nov. 5, 2018 (IN) ..... 201811041891

(51) Int. Cl.
*B22C 5/00* (2006.01)
*B01F 27/91* (2022.01)
*B01F 35/53* (2022.01)

(52) U.S. Cl.
CPC ..... *B01F 27/91* (2022.01); *B01F 35/531* (2022.01); *B01F 2215/0422* (2013.01)

(58) Field of Classification Search
CPC ..... B01F 7/22; B01F 35/531
See application file for complete search history.

(56) References Cited

U.S. PATENT DOCUMENTS 4,568,193 A * 2/1986 Contri ..... H02P 25/145 388/906
6,431,744 B1 * 8/2002 Ash ..... A47J 43/0727 366/205
8,721,165 B2 * 5/2014 Conti ..... A47J 43/0727 366/205
9,707,526 B2 * 7/2017 Song ..... B01F 7/183
2006/0263501 A1 * 11/2006 Oghafua ..... A47J 27/004 426/523
2013/0089925 A1 * 4/2013 Damren ..... F28F 9/0131 435/303.1

(Continued)

FOREIGN PATENT DOCUMENTS

CN 102068955 A * 5/2011
CN 104870082 A 8/2015
CN 107028473 A * 8/2017 ..... A47J 19/02

OTHER PUBLICATIONS

Google machine translation for CN-102068955-A (Year: 2011).*

(Continued)

*Primary Examiner* — Anshu Bhatia
*Assistant Examiner* — Gregory Y Huan
(74) *Attorney, Agent, or Firm* — Perilla Knox & Hildebrandt LLP; Kenneth A. Knox

(57) ABSTRACT

An apparatus for agitation of fluids is described that comprises an agitation chamber, an impeller configured to have a motor, a shaft, and blades, and a plurality of baffles. Further, the plurality of baffles have a predetermined shape and configuration. Further, the plurality of baffles are placed on a side wall of the agitation chamber.

19 Claims, 5 Drawing Sheets

(56) References Cited

U.S. PATENT DOCUMENTS

| | | | | |
|---|---|---|---|---|
| 2016/0129409 | A1* | 5/2016 | Drees | A47J 43/0722<br>366/241 |
| 2016/0317983 | A1* | 11/2016 | Jones | B28C 5/02 |

OTHER PUBLICATIONS

Google machine translation for "CN-107028473-A" (Year: 2017).*
International Search Report and Written Opinion for PCT/IB2018/060146 dated Jan. 28, 2019.
First Examination Report for Indian Patent Application No. 201811041891 dated Jan. 28, 2019.
Response to First Examination Report for Indian Patent Application No. 201811041891 filed Aug. 6, 2019.
Intention to Grant Letter for Indian Patent Application No. 201811041891 dated Sep. 4, 2019.

* cited by examiner

APPARATUS FOR AGITATION OF FLUIDS

CROSS-REFERENCE TO RELATED APPLICATION

This application is a § 371 national phase application of PCT/IB2018/060146 filed Dec. 15, 2018 entitled "AN APPARATUS FOR AGITATION OF FLUIDS," which claims the benefit of and priority to Indian Patent Application No. 201811041891 filed Nov. 5, 2018, the contents of which being incorporated by reference in their entireties herein.

TECHNICAL FIELD

Embodiments of the present disclosure generally relate to fluid mechanics and more particularly to an apparatus for agitation of fluids.

BACKGROUND

Mixing is very primitive and popular for human civilization. Mixing, as such, has changed according to luxury and need for mankind. Mixing is the most important and preliminary mechanical operation carried out in each of different types of processing industries. Uniform and thorough mixing is desired to complete various mechanical operations as well as chemical operations in less time and in a satisfactory manner.

A fully baffled condition (complete vortex elimination, defined as 100% baffle effectiveness) is produced by four flat plates (shape) located at the sidewall of the vessel (placement), of width equal to 1/12 of the vessel's diameter (size). They typically extend the length of the vessel's straight side and are spaced at 90-degree intervals. While four sidewall baffles are generally used in alloy vessel construction, they are not practical in glass-lined reactors. Consequently, glass-lined vessels typically have one baffle which is supported from a top head nozzle. Over the years several different styles of glass-lined baffles have evolved, each one providing improved baffle effectiveness (i.e., vortex reduction) over its predecessors.

The Concave Baffle is another design in glass-lined baffle technology. The premise behind the Concave Baffle is to maximize the drag coefficient of the baffle. For the Concave Baffle, the drag coefficient is 2.3. For a flattened pipe, it is 1.3. This results in increased power investment. The "reaction" which is related to this increase in drag force results in an increase in both energy dissipation (power draw) and top-to-bottom turnover within the vessel.

Therefore, there is a need in the art for an effective agitation of fluids which does not suffer from above mentioned limitations and would maximize the mixing of fluids while also being able to be used in different kinds of reactors.

SUMMARY OF THE INVENTION

According to an aspect of the disclosure, an apparatus for agitation of fluids is provided. The apparatus comprises an agitation chamber, an impeller configured to have a motor, a shaft and blades, and a plurality of baffles.

The plurality of baffles have a predetermined shape and configuration.

The plurality of baffles are placed on sidewalls of the agitation chamber.

In accordance with an embodiment of the present disclosure, said fluid is a newtonian fluid or a non-newtonian fluid.

In accordance with an embodiment of the present disclosure, said agitation chamber has a predefined shape.

In accordance with an embodiment of the present disclosure, said motor of said impeller is connected at one end of said shaft and said blades are connected at another end of said shaft.

In accordance with an embodiment of the present disclosure, said plurality of baffles are sharp edge baffles.

In accordance with an embodiment of the present disclosure, said sharp edge baffles have, but are not limited to, a triangular cross section.

In accordance with an embodiment of the present disclosure, said plurality of baffles have a varying width.

In accordance with an embodiment of the present disclosure, said width increases from a top to a bottom of said agitation chamber.

In accordance with an embodiment of the present disclosure, said varying width baffle has a width gradient in the range, but is not limited to, 0.03-0.08.

In accordance with an embodiment of the present disclosure, said plurality of baffles are made of materials such as, but not limited to, polymer, steel, alloys, and glass.

In accordance with an embodiment of the present disclosure, the plurality of baffles protrude from sidewalls of the agitation chamber at a predefined degree between 30° to 180°.

In accordance with an embodiment of the present disclosure, said predetermined shape of said plurality of baffles are configured to enhance and aid mixing rate and thus faster cooling and heating of fluid and/or semi-fluid substances.

In accordance with an embodiment of the present disclosure, said plurality of baffles are configured to make the Temperature Gradient uniform and also aid in achieving rapid control on temperature to attain a uniform temperature regime within said agitation chamber.

BRIEF DESCRIPTION OF DRAWINGS

So that the manner in which the above recited features of the present disclosure can be understood in detail, a more particular description of the disclosure, briefly summarized above, may have been referred by examples, some of which are illustrated in the appended drawings. It is to be noted, however, that the appended drawings illustrate only typical examples of this disclosure and are therefore not to be considered limiting of its scope, for the disclosure may admit to other equally effective examples.

These and other features, benefits, and advantages of the present disclosure will become apparent by reference to the following text figure, with like reference numbers referring to like structures across the views, wherein.

DETAILED DESCRIPTION

Figure 1:
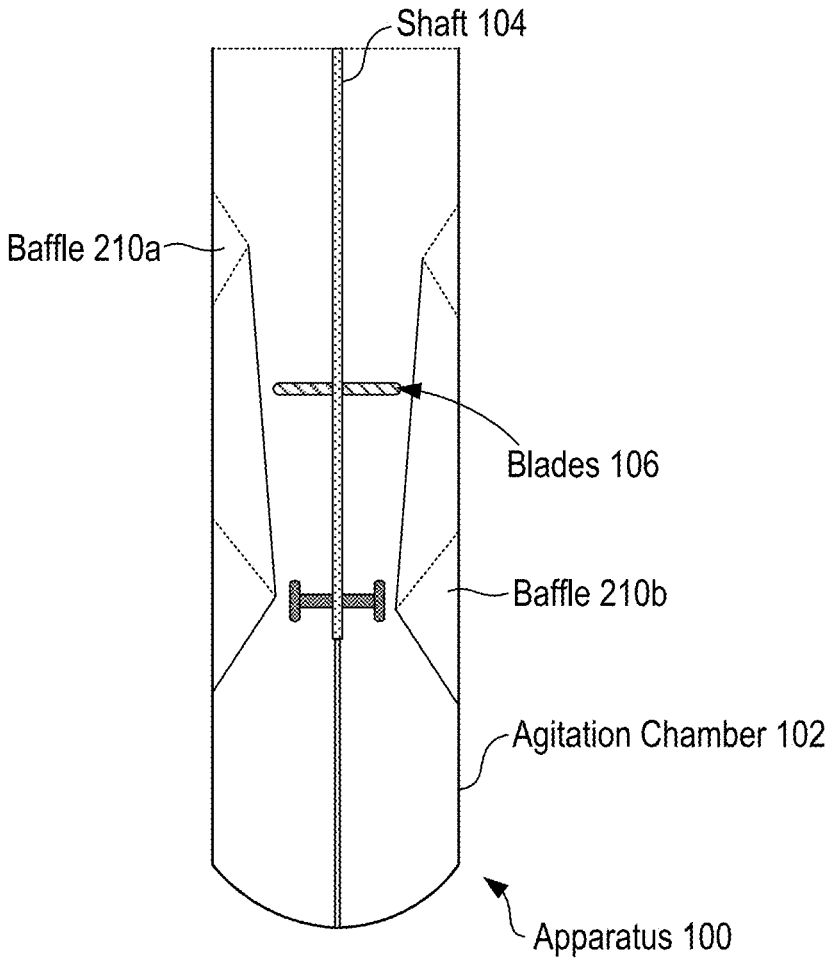
FIG. 1 illustrates a side view of an apparatus for agitation of fluids, in accordance with an embodiment of the present disclosure.

While the present disclosure is described herein by way of example using embodiments and illustrative drawings, those skilled in the art will recognize that the disclosure is not limited to the embodiments of drawing or drawings described, and are not intended to represent the scale of the various components. Further, some components that may form a part of the disclosure may not be illustrated in certain figures, for ease of illustration, and such omissions do not limit the embodiments outlined in any way. It should be understood that the drawings and detailed description thereto are not intended to limit the disclosure to the particular form disclosed, but on the contrary, the disclosure is intended to cover all modifications, equivalents, and alternatives falling within the scope of the present disclosure as defined by the appended claims. As used throughout this description, the word "may" is used in a permissive sense (i.e., meaning having the potential to), rather than the mandatory sense, (i.e., meaning must). Further, the words "a" or "an" mean "at least one" and the word "plurality" means "one or more" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers, or steps. Likewise, the term "comprising" is considered synonymous with the terms "including" or "containing" for applicable legal purposes. Any discussion of documents, acts, materials, devices, articles, and the like is included in the specification solely for the purpose of providing a context for the present disclosure. It is not suggested or represented that any or all of these matters form part of the prior art base or were common general knowledge in the field relevant to the present disclosure.

In this disclosure, whenever a composition or an element or a group of elements is preceded with the transitional phrase "comprising", it is understood that the same composition, element, or group of elements are contemplated with transitional phrases "consisting of", "consisting", "selected from the group of consisting of, "including", or "is" preceding the recitation of the composition, element, or group of elements, and vice versa.

The present disclosure is described hereinafter by various embodiments with reference to the accompanying drawings, wherein reference numerals used in the accompanying drawing correspond to the like elements throughout the description. This disclosure may, however, be embodied in many different forms and should not be construed as limited to the embodiment set forth herein. Rather, the embodiments are provided so that this disclosure will be thorough and complete and will fully convey the scope of the disclosure to those skilled in the art. In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the invention.

Figure 4:
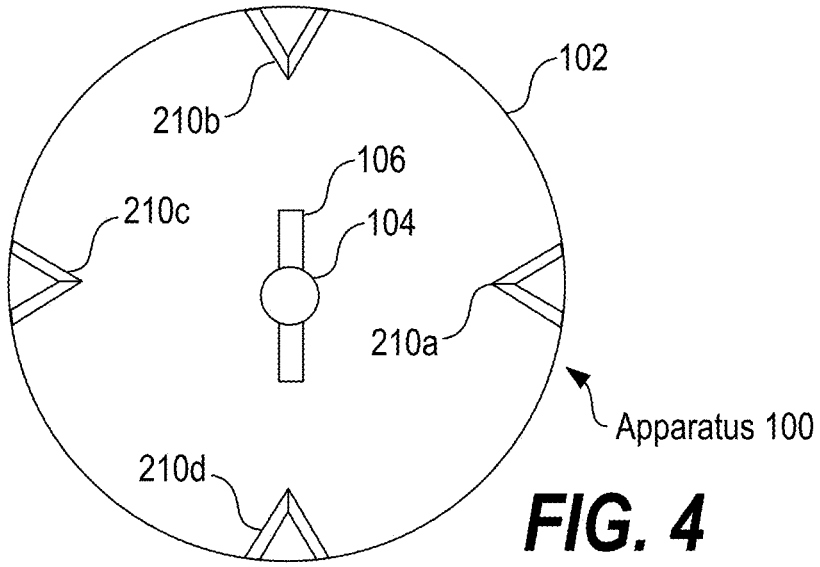
FIG. 4 illustrates a top view of the apparatus for agitation of fluids of FIG. 1, in accordance with an embodiment of the present disclosure.
Figure 5:
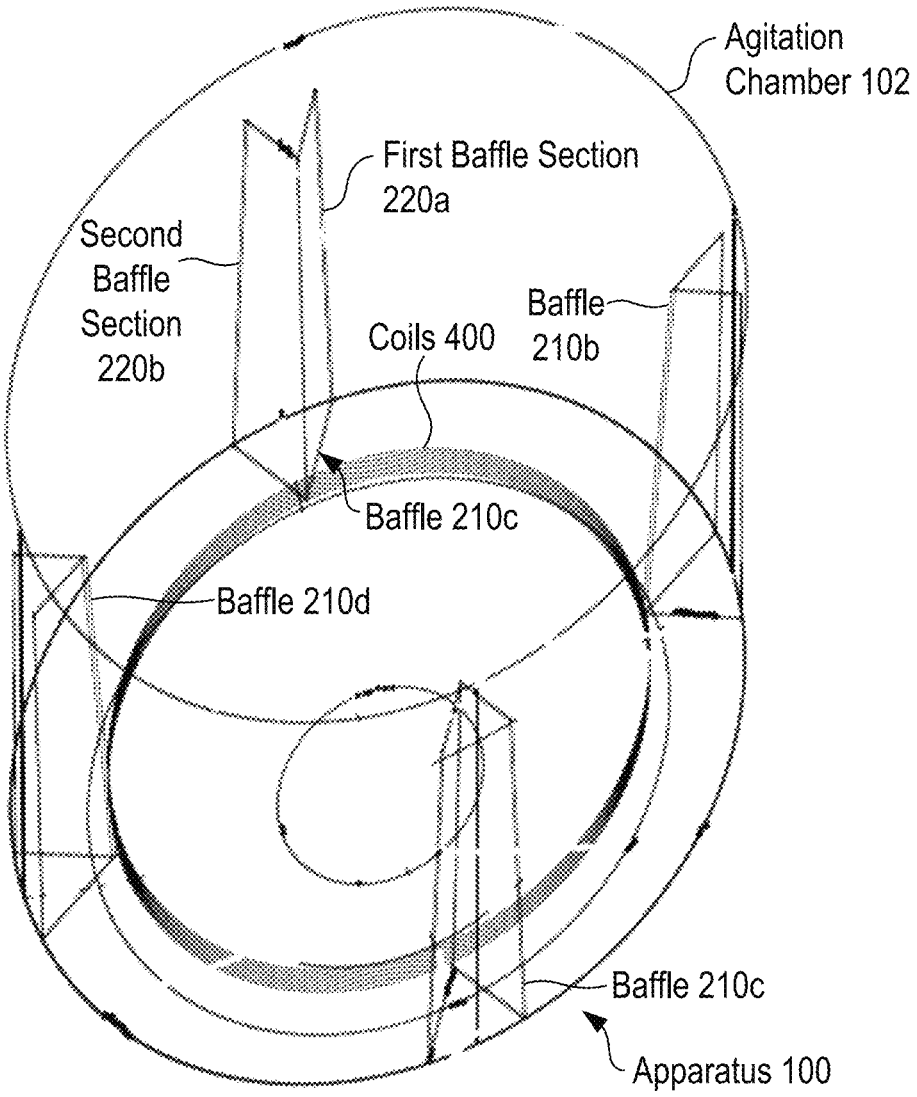
FIG. 5 illustrates a perspective view of the apparatus for agitation of fluids of FIG. 1, in accordance with an embodiment of the present disclosure.

FIG. 1, FIG. 4, and FIG. 5 illustrate an apparatus (100) for agitation of fluids (hereinafter referred as the apparatus (100)), in accordance with an embodiment of the present invention. As shown in these figures, the apparatus (100) for agitation fluids comprises an agitation chamber (102), an impeller configured to have a motor, a shaft (104) and blades (106), and a plurality of baffles (210*a*-210*d*) (collectively "baffles (210)" or individually "baffle (210)"). The impeller may be, but is not limited to, a propeller or a turbine. The agitation chamber (102) may have a predefined shape such as, but not limited to, cylindrical, spherical, cuboidal, etc. The agitation chamber (102) may be made of, but is not limited to, stainless steel, fiber glass, and the like having the plurality of baffles (210). The plurality of baffles (210) may be configured to make the Temperature Gradient uniform and also aid in achieving rapid control on temperature to attain uniform temperature regime within the agitation chamber (102).

Each of the baffles (210) may be formed up of a first baffle section (220*a*) and a second baffle section (220*b*). In other words, the first baffle section (220*a*) and the second baffle section (220*b*) may be formed to define a share edge facing towards the impeller such that a bottom end of a respective baffle (210) is closer than an impeller as opposed to the top end of the respective baffle (210). Opposing sides of the first baffle section (220*a*) and the second baffle section (220*b*) may be coupled to sidewalls (390) of the agitation chamber (102). The first baffle section (220*a*) and the second baffle section (220*b*) may be planar, symmetrical, and trapezoidal-shaped.

The shape of the plurality of baffles (210) are configured to enhance and aid mixing rate and thus faster cooling and heating rate of fluids. The plurality of baffles (210) may have a cross-section selected from a group comprising, but not limited to, conical, concave, triangular, and trapezoidal. The plurality of baffles (210) may be placed on the walls of inside of the agitation chamber (102). For instance, the plurality of baffles (210) are placed at an angle may be, but not limited to, 45°, 90°, etc. with respect to the wall of the agitation chamber (102). The angle may be based on the fact that the apparatus (100) may achieve maximum agitation of fluids. The plurality of baffles (210) may be made of materials, but not limited to, polymer, steel, alloys, glass.

The impeller may have the motor, such as an electrical motor, with the shaft (104), such as an elongated shaft, that is installed inside the agitation chamber (102). The shaft (104) may be fixed with plurality of and blades (106). The motor to drive the impeller may be connected at one end of the shaft (104) and the blades (106) may be connected at another end of the shaft (104).

In an embodiment, the apparatus (100) comprises an axially symmetric shaft (104) to mount different types of impellers. The speed for the operation of impellers may be obtained by, but is not limited to, a 0.5 hp electrical motor attached to the shaft (104) by a belt drive. The constant speeds required may be controlled by a speed regulator, and the speed measurement and the speed may be recorded using a tachometer.

Figure 2A:
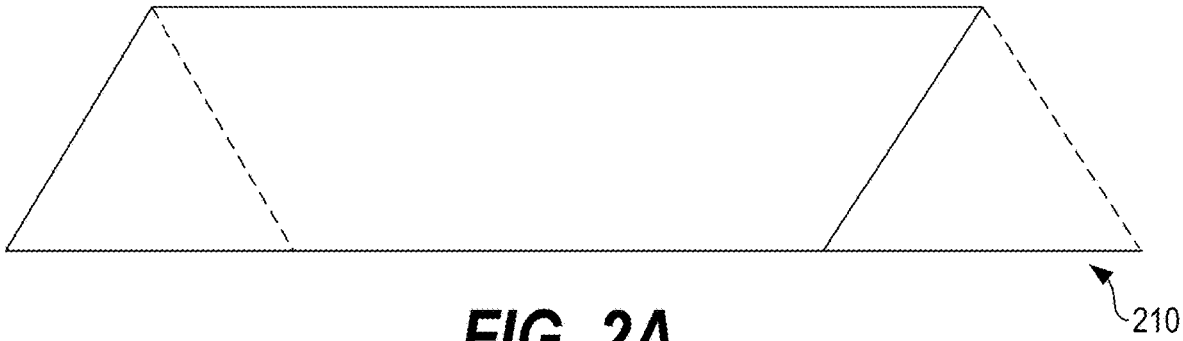
FIG. 2A illustrates side view of the baffle, in accordance with an embodiment of the present disclosure.

FIG. 2A illustrates side view of the baffle (210), in accordance with an embodiment of the present disclosure. In an embodiment, the baffle (210) has, but is not limited to, a triangular cross section. The sharp edge of the triangle may be pointed towards the impeller. The plurality of baffles (210) may cut the flux of the liquid under circulation to produce more turbulence and hence improve the mixing. Also, the portion of the fluid that impinges at the sharp edge will be equally divided in two opposite directions which latter impinge on the wall of the tank and rebound back to the impeller and blades (106). So, this cycle of fluid motion is repeated at a very high rate which results in high turbulence and better mixing.

Figure 2B:
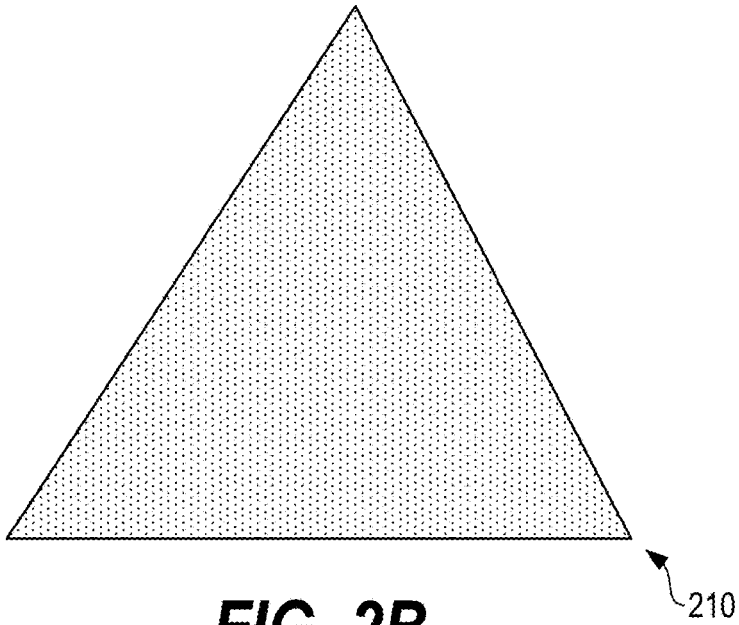
FIG. 2B illustrates cross-sectional view of the baffle, in accordance with an embodiment of the present disclosure.

FIG. 2B illustrates a cross-sectional view of each of the plurality of baffles (210) in accordance with an embodiment of the present disclosure. Each of the plurality of the baffles (210) may have a cross-section shaped such as, but not limited to, a triangular shape, a conical shape, and a concave shape. In an embodiment, the shape of cross-section of each of the plurality of the baffles (210) is a triangular shape.

Figure 3:
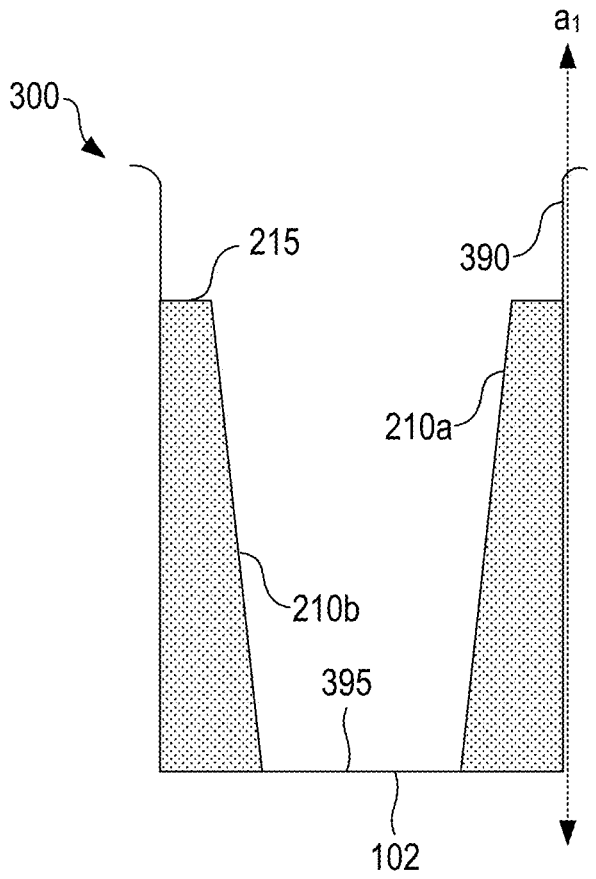
FIG. 3 illustrates an arrangement of plurality of baffles, in accordance with another embodiment of the present disclosure.

FIG. 3 illustrates an arrangement (300) of plurality of baffles (210) in accordance with another embodiment of the present disclosure. As shown in FIG. 3, the plurality of baffles (210) may have a varying width. The varying width may increase from one end to the other end of the agitation chamber (102). A varying width baffle may have a width gradient. In an exemplary embodiment, the width gradient is between the range 0.03-0.08. In some specific embodiments, the width gradient is 0.05. The arrangement (300) works in following manner. The different fluids are taken in the agitation chamber (102) with the baffles (210) on the wall of the agitation chamber (102). The plurality of baffles (210) have a triangular cross section and the sharp edges thereof are pointed towards the impeller. So, the pointed edge of the baffles (210) would cut the flux of the liquid under circulation to produce more turbulence and hence causes the mixing. Also, the portion of the fluid that impinges at the sharp edge would be equally divided in two opposite direction which latter impinge on the wall of the agitation chamber (102) (e.g., a tank) and rebound back to the impeller and blades (106). So, this cycle of fluid motion is repeated at a very high rate which results in turbulence and mixing.

As shown in FIG. 3, the plurality of baffles (210) include at least a first baffle (210*a*) and a second baffle (210*b*) on opposing sides of the agitation chamber (102). Each baffle (210) extends vertically along a longitudinal axis al of sidewalls (390) of the agitation chamber (102). Each of the first baffle (210*a*) and the second baffle (210*b*) have a side coupled to the sidewalls (390) of the agitation chamber (102) and a bottom coupled to a bottle surface (395) of the agitation chamber (102). Again, the first baffle (210*a*) and the second baffle (210*b*) each have a triangular cross-section with sharp edges. The triangular cross-section may resemble a prism across the cross-section. The plurality of baffles (210*a*) may include a top edge (215) being substantially perpendicular to the sidewalls (390) of the agitation chamber (102). Again, the plurality of baffles 210 may have a varying width with a width gradient in the range of 0.03-0.08 increasing from the top edge to the bottom coupled to the bottom surface (395), such that an area of contact with moving fluid varies from the top to the bottom of the agitation chamber (102). The sharp edges of the plurality of baffles (210) point towards the impeller (or the shaft (104) thereof), such that the sharp edges of the plurality of baffles (210) are operable to cut a flux of fluid under circulation to produce turbulence, and divide a portion of the fluid impinging at the sharp edge in two opposite directions which impinge on the sidewalls (395) of the agitation chamber (102) and rebound back to the impeller, the shaft (104), and the blades (106).

Where the plurality of baffles (210) having the width increasing from top to bottom of the agitation chamber (102). The area of contact with moving liquid would continuously vary from top to bottom in a stirrer tank. So, due to variable contact area this baffle (210) would produce turbulence in case of highly viscous liquids. At or near the bottom of tank, the gap between the baffle (210) and the blade (106) of the impeller would be less. So, in this particular case, the energy of fluid at the bottom would be much higher than the fluid at the top of the tank. This would give rise to difference in pressure energy for the fluid at the top and the bottom, and would result in a mixing of fluids.

The present disclosure offers a number of advantages. The disclosure produces static uniformity in multi-component multiphase system of a plurality of fluids in different phases. The disclosure also produces dynamic uniformity in agitation of multi component multiphase systems. It also facilitates better mass transfer along with the heat transfer between the parts of a systems that are not in equilibrium. The pointed edge of the baffle (210) cuts the flux of the liquid under circulation to produce more turbulence and hence improve the mixing. Also, the portion of the fluid that impinges at the sharp edge will be equally divided in two opposite directions which impinge on the wall of the agitation chamber (102) and rebound back to the impeller and blades (106). So, this cycle of fluid motion is repeated at a very high rate which results in high turbulence and better mixing. FIG. 4 shows a top view of the apparatus (100) having four ones of the baffles (210*a* . . . 210*d*).

Figure 6:
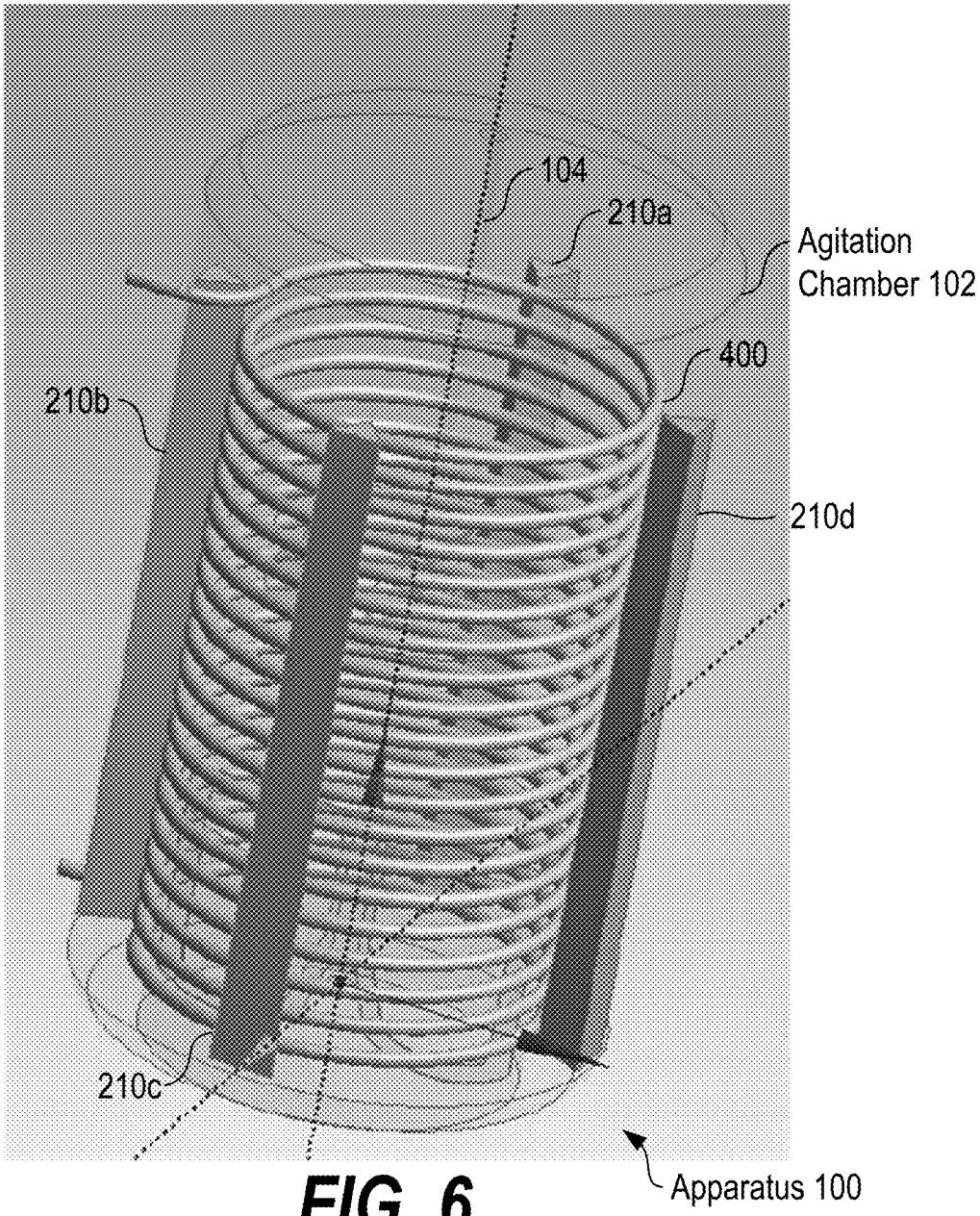
FIG. 6 illustrates another a perspective view of the apparatus for agitation of fluids of FIG. 1, in accordance with an embodiment of the present disclosure.

In the baffle (210) with a width increasing from a top to a bottom of the agitation chamber (102), the area of contact with a moving liquid is continuously varying from the top to the bottom in a stirrer tank, thus, it will enhance heat transfer to the fluid in chamber by virtue of having coils (400), shown in FIGS. 5 and 6, with a uniformly increasing width of the baffles (210). So due to variable contact area this baffle will produce turbulence in case of highly viscous liquids. At or near the bottom of the agitation chamber (102), the gap between the baffles (210) and the blade (106) of the impeller will be less. So, in this particular case, the energy of fluid at the bottom will be much higher than the fluid at the top of the tank. This will also give rise to difference in pressure energy for the fluid at the top and the bottom.

As shown in FIG. 6, the baffles (210) may extend towards the shaft (104) of the impeller such that the sharp edges of the baffles (210) come into contact with the coils (400).

Additionally, the baffles (210) may be used for, but not limited to, biochemical reactors, such as reactors where there is an increase or decrease in a degree of volume expansion and for generic drug manufacturing reactors.

Furthermore, the baffle (210) having a varying width has the advantages of transferring and modulation of pressure energy intensity in static structures, like pier and bridge foundations where the beam stability requires transverse motions. The varying width aids in stability of heavy structures with vibrations and has advantage over spring system due to long life by maintaining the tensile strength, etc.

Various modifications to these embodiments are apparent from the description to those skilled in the art. The principles associated with the various embodiments described herein may be applied to other embodiments. Therefore, the description is not intended to be limited to the embodiments but is to be providing broadest scope consistent with the principles and the novel and inventive features disclosed and/or suggested herein. Accordingly, the disclosure is anticipated to hold on to all other such alternatives, modifications, and variations that fall within the scope of the present disclosure and appended claims.

I claim:

1. A reactor for agitation of fluids, comprising:

an agitation chamber;

an impeller configured for agitation that comprises a motor, a shaft, and a plurality of blades fixed on the shaft;

a plurality of coils; and a plurality of baffles comprising at least a first baffle and a second baffle on opposing sides of the agitation chamber, each extending vertically along a longitudinal axis of sidewalls of the agitation chamber, each of the first baffle and the second baffle having a side coupled to the sidewalls of the agitation chamber and a bottom coupled to bottom surface of the agitation chamber, the first baffle and the second baffle each having a triangular cross-section with sharp edges, wherein:

the triangular cross-section resembles a prism across the cross-section;

the plurality of baffles have a varying width with a width gradient in the range of 0.03-0.08 increasing from the top edge to the bottom coupled to the bottom surface, such that an area of contact with moving fluid varies from the top to the bottom of the agitation chamber; and the sharp edges of the plurality of baffles point towards the impeller, such that the sharp edges of the plurality of baffles are operable to cut a flux of fluid under circulation to produce turbulence, and divide a portion of the fluid impinging at the sharp edge in two opposite directions which impinge on the sidewalls of the agitation chamber and rebound back to the impeller and the blades.

2. The reactor of claim 1, wherein the fluid is a non-newtonian fluid.

3. The reactor of claim 1, wherein the motor of the impeller is connected at one end of the shaft and the blades are connected at another end of the shaft.

4. The reactor of claim 1, wherein the plurality of baffles are made of at least one of: polymer, steel, alloys, and glass.

5. The reactor of claim 1, wherein the plurality of baffles are spaced at a predefined interval between 30° to 180° on the sidewalls of the agitation chamber.

6. The reactor of claim 1, wherein the plurality of baffles are configured to enhance and aid a mixing rate, a cooling rate, and a heating rate of fluids.

7. The reactor of claim 1, wherein:

the agitation chamber has a cylindrical shape, a spherical shape, or a cuboidal shape; and the agitation chamber is made of stainless steel or fiber glass.

8. The reactor of claim 1, wherein each of the plurality of baffles protrude from sidewalls of the agitation chamber at a predetermined angle, wherein the predetermined angle is 45° or 90°.

9. The reactor of claim 1, further comprising a speed regulator and a tachometer, the speed regulator being configured to drive the impeller by regulating a speed of the impeller using a speed measurement recorded by the tachometer.

10. A method for agitation of fluids, comprising:

providing an agitating reactor, the agitating reactor comprising:

an agitation chamber;

an impeller configured for agitation that comprises a motor, a shaft, and a plurality of blades fixed on the shaft;

a plurality of coils; and a plurality of baffles comprising at least a first baffle and a second baffle on opposing sides of the agitation chamber, each extending vertically along a longitudinal axis of sidewalls of the agitation chamber, each of the first baffle and the second baffle having a side coupled to the sidewalls of the agitation chamber and a bottom coupled to a bottom surface of the agitation chamber, the first baffle and the second baffle each having a triangular cross-section with sharp edges, wherein:

the triangular cross-section resembles a prism across the cross-section;

the plurality of baffles have a varying width with a width gradient in the range of 0.03-0.08 increasing from the top edge to the bottom coupled to the bottom surface, such that an area of contact with moving fluid varies from the top to the bottom of the agitation chamber; and the sharp edges of the plurality of baffles point towards the impeller, such that the sharp edges of the plurality of baffles are operable to cut a flux of fluid under circulation to produce turbulence, and divide a portion of the fluid impinging at the sharp edge in two opposite directions which impinge on the sidewalls of the agitation chamber and rebound back to the impeller and the blades.

11. The method according to claim 10, further comprising driving the impeller using the motor attached to the shaft.

12. The method according to claim 11, wherein driving the impeller further comprises regulating a speed of the impeller using a speed regulator that utilizes a speed measurement recorded by a tachometer.

13. The method of claim 10, wherein the fluid is a non-newtonian fluid.

14. The method of claim 10, wherein the motor of the impeller is connected at one end of the shaft and the blades are connected at another end of the shaft.

15. The method of claim 10, wherein the plurality of baffles are made of at least one of: polymer, steel, alloys, and glass.

16. The method of claim 10, wherein the plurality of baffles are spaced at a predefined interval between 30° to 180° on the sidewalls of the agitation chamber.

17. The method of claim 11, further comprising enhancing and aiding at least one of a mixing rate, a cooling rate, and a heating rate of fluids using the plurality of baffles.

18. The method of claim 10, wherein:

the agitation chamber has a cylindrical shape, a spherical shape, or a cuboidal shape; and the agitation chamber is made of stainless steel or fiber glass.

19. The method of claim 10, wherein each of the plurality of baffles protrude from sidewalls of the agitation chamber at a predetermined angle, wherein the predetermined angle is 45° or 90°.

* * * * *